US008702020B2

(12) United States Patent
Gopalan

(10) Patent No.: US 8,702,020 B2
(45) Date of Patent: Apr. 22, 2014

(54) NOZZLE AND FLUIDIC CIRCUIT ADAPTED FOR USE WITH COLD FLUIDS, VISCOUS FLUIDS OR FLUIDS UNDER LIGHT PRESSURE

(75) Inventor: Shridar Gopalan, Westminster, MD (US)

(73) Assignee: Bowles Fluidics Corporation, Columbia, MD (US)

( * ) Notice: Subject to any disclaimer, the term of this patent is extended or adjusted under 35 U.S.C. 154(b) by 565 days.

(21) Appl. No.: 12/467,270

(22) Filed: May 16, 2009

(65) Prior Publication Data

US 2010/0276521 A1 Nov. 4, 2010

Related U.S. Application Data

(60) Provisional application No. 61/071,778, filed on May 16, 2008.

(51) Int. Cl.
*B05B 1/08* (2006.01)

(52) U.S. Cl.
USPC ..... 239/589.1; 239/589

(58) Field of Classification Search
USPC ..... 239/589.1, 370, 302, 284.1, 284.2; 137/809, 810, 812, 813
See application file for complete search history.

(56) References Cited

U.S. PATENT DOCUMENTS

| | | | | |
|---|---|---|---|---|
| 4,184,636 | A * | 1/1980 | Bauer | 239/11 |
| 4,463,904 | A * | 8/1984 | Bray, Jr. | 239/589.1 |
| 4,508,267 | A * | 4/1985 | Stouffer | 239/11 |
| 4,645,126 | A * | 2/1987 | Bray, Jr. | 239/11 |
| 5,860,603 | A * | 1/1999 | Raghu et al. | 239/589.1 |

* cited by examiner

*Primary Examiner* — Davis Hwu
(74) *Attorney, Agent, or Firm* — J.A. McKinney & Assoc., LLC

(57) ABSTRACT

A fluid spraying or nozzle system adapted for use with cold fluids, viscous fluids or fluids under light pressure includes a fluidic oscillator having a power nozzle and an oscillation chamber coupled to the power nozzle for issuing a jet of fluid into the oscillation chamber and an outlet aperture spraying a jet of fluid into ambient space. The oscillator's walls define an oscillation inducing interaction region causing the jet of fluid to rhythmically sweep back and forth between the sidewalls in the oscillation chamber. The oscillation inducing interaction region defines an outlet throat width which is adapted to work with the power nozzle's width and an a bell-shaped feed that spreads the fluid jet as it leaves the power nozzle, so that the interaction region and feedback channels are quickly filled with fluid at a low pressure and the fluidic oscillator is activated to generate a desired fan pattern of fluid spray.

16 Claims, 2 Drawing Sheets

NOZZLE AND FLUIDIC CIRCUIT ADAPTED FOR USE WITH COLD FLUIDS, VISCOUS FLUIDS OR FLUIDS UNDER LIGHT PRESSURE

PRIORITY CLAIM AND REFERENCE TO RELATED APPLICATION

This application claims priority to related, commonly owned U.S. provisional patent application No. 61/071,778, filed May 16, 2008, the entire disclosure of which is incorporated herein by reference.

BACKGROUND OF THE INVENTION

1. Field of the Invention

The present invention relates to nozzles and fluidic circuits for generating a controlled spray pattern.

2. Discussion of the Prior Art

Fluidic inserts or oscillators are well known for their ability to provide a wide range of distinctive liquid sprays. The distinctiveness of these sprays is due to the fact that they oscillate, as compared to the relatively steady state flows or streams emitted from standard spray nozzles.

For ease of construction, fluidic oscillators or inserts are generally manufactured as thin, rectangular members that are molded or fabricated from plastic so as to have specially-designed liquid flow channels fabricated into either their broader top or bottom surfaces. They are typically inserted into the cavity of a housing whose inner walls are configured to form a liquid-tight seal around the insert's boundary surface which contains the specially-designed flow channels. Pressurized liquid enters such an insert and is sprayed from it. However, it should be noted that fluidic oscillators can be constructed so that their liquid flow channels are placed practically anywhere (e.g., on a plane that passes through the member's center) within the member's body: in such instances the fluidic would have a clearly defined channel inlet and outlet.

There are many well known designs of fluidic circuits that are suitable for use with such fluidic inserts. Many of these have some common features, including: (a) at least one power nozzle configured to accelerate the movement of the liquid that flows under pressure through the insert, (b) an interaction chamber through which the liquid flows to initiate flow phenomena and cause spray oscillation, (c) a liquid inlet, (d) a pathway that connects the inlet and the outlet(s) or power nozzle(s), and (e) the outlet throat from which the liquid sprays.

Fluidic circuits have been incorporated into a variety of nozzle assemblies and sprayers for various applications. For example, U.S. Pat. No. 5,749,525, U.S. Pat. RE38013, U.S. Pat. No. 4,508,267 and U.S. Pat. No. 4,443,904 illustrate the state of the art and are incorporated herein by reference for enablement purposes, illustrating the level of skill in the art, broadly speaking.

U.S. Pat. No. 5,749,525 (Stouffer) discloses a fluidic oscillator for vehicle windshield washer systems in which a housing, which can be commonly used on different vehicles, incorporates a fluidic oscillator element, hereinafter termed a "fluidic insert", which carries a physical silhouette or pattern of a fluidic oscillator and is adapted to create different deflection angles. As used herein, the term "deflection angle" means the angle that the jet of wash liquid makes as it exits the outlet in a plane orthogonal to the plane of the silhouette, and the term "fan angle" is the angle made by the jet sweeping back and forth between the boundaries of the outlet in the plane of the silhouette.

Stouffer's U.S. Pat. No. 4,508,267 entitled LIQUID OSCILLATOR DEVICE and Bray, Jr.'s U.S. Pat. No. 4,463,904 entitled COLD WEATHER FLUIDIC FAN SPRAY DEVICES AND METHOD disclose fluidic oscillators which have been highly successful. They include a housing with a fluidic insert element having the silhouette of a fluidic oscillator, and the insert carried in the housing. The silhouette of the fluidic oscillator typically is of the type disclosed in aforementioned Stouffer U.S. Pat. No. 4,508,267 and Bray, Jr. U.S. Pat. No. 4,463,904, although other forms of fluidic oscillators may be used. This type of fluidic oscillator has a power nozzle issuing a jet of windshield washer liquid into an oscillation chamber towards an outlet which issues the jet of wash liquid into ambient space where it is oscillated to rhythmically sweep back and forth, causing the liquid jet to break up in droplets of predetermined size, configuration or range to impinge on a windshield in a predetermined position under various driving conditions (as disclosed in U.S. Pat. No. 4,157,161). In the Bray, Jr. patent, the Coanda effect wall attachment (or lock-on effect) cause a dwell at the ends of the sweep which tends to make the spray heavier at the ends of the sweep than in the middle. In the Stouffer U.S. Pat. No. 4,508,267, the configuration of the silhouette causes the liquid oscillator to sweep a fan spray with liquid droplets that are relatively uniform throughout the fan spray pattern, and the uniform droplets provide a better cleaning action.

These nozzles devices do not work well under certain conditions, however. For example, cold environments can be challenging, especially if the fluid changes viscosity significantly over the temperature range encountered by the nozzle or sprayer. The prior art nozzles and fluidic circuits will not provide a reliable and effective spray pattern at cold temperatures (e.g., near 0° F.). Fluids or liquids used at such temperatures include alcohol mixtures with water and have low freezing points. Thus, the viscosity of the liquid is high (e.g. 25 cP, where water viscosity at Room Temperature ("RT") is 1 cP). The prior art fluidic circuits include feedback inducing structural features and those circuits are not satisfactory for many applications, such as headlamp cleaning with a mixture of 50-50 ethanol-water at −4 F, or a squeeze bottle spray with fluid under light pressure.

There is a need, therefore, for an improved cold-fluid tolerant apparatus and method for generating three dimensional or planar sprays in controlled patterns with cold or viscous fluids or liquids.

OBJECTS AND SUMMARY OF THE INVENTION

Accordingly, it is an object of the present invention to overcome the above mentioned difficulties by providing an improved cold fluid tolerant apparatus and method for generating three dimensional or planar sprays in controlled patterns with cold or viscous fluids or liquids.

The nozzle system of the present invention is adapted for use with cold or viscous fluids and includes a fluidic oscillator having a power nozzle and an oscillation chamber coupled to the power nozzle for issuing a jet of fluid into the oscillation chamber and an outlet aperture spraying a jet of fluid into ambient space. The oscillator's walls define an oscillation inducing interaction region causing the jet of fluid to rhythmically sweep back and forth between the sidewalls in the oscillation chamber. The oscillation inducing interaction region defines an outlet throat width which is adapted to work with the power nozzle's width and an a bell-shaped feed that spreads the fluid jet as it leaves the power nozzle, so that the interaction region and feedback channels are quickly filled with fluid at a low pressure and the fluidic oscillator is activated.

This set of features was developed to enhance a characteristic identified as "Cold Performance" ("CP"), which is defined as the ability of a nozzle to spray effectively at cold temperatures (e.g. 0° F.). The liquid used at such temperatures can be an alcohol mix with water that has a low freezing point. Thus, the viscosity of the liquid is high (e.g. 25 cP; where water viscosity at RT is 1 cP). In essence, then, the object of the present invention. CP, can be considered as the ability of a nozzle to spray thick or viscous liquids into a desired spray pattern. CP is required for automotive washer and headlamp nozzles. CP feedback is well suited for 3D spray nozzles in headlamp cleaning applications. In addition, it can also be used for windshield washer nozzles.

The existing feedback circuits are not satisfactory for some applications, where CP requirements are high and the existing feedback circuits cannot perform. Examples are (a) three dimensional ("3D") spray pattern nozzles for headlamp cleaning with a mixture of 50-50 ethanol-water at low temperatures (e.g. −4° F.), and (b) manual squeeze bottle spray applicators and the like.

In the headlamp cleaning application, an excessively high nozzle pressure was required for the nozzle to generate an acceptable 3D "fan" pattern with the liquid mixture described above. This excessively high nozzle pressure was not available from a commercially reasonable pumping system, thus the performance was not acceptable. With the CP feedback nozzle assembly of the present invention, the pressure requirement for a 3D fan spray was lowered by about 10 psi, making it a feasible product.

A similar situation exists in squeeze bottle spray applications, where the required fluid pressure must be generated by a user's hand squeeze. Hand squeeze pressures are very low (e.g., typically in the range of 0.5-0.9 PSI). For a nozzle to spray (fan) at such pressures, the applicant has found that a nozzle's CP must be superior.

It has been discovered that the reason for this is that at such low pressures (0.5-0.9 psi), flow rate is low (and so is velocity) and Reynolds number (Re) is low. For fluidic circuits applicants have analyzed, it was found that each circuit has its own characteristic critical number $Re_{cr}'$ when it emits a fan spray (instead of an ordinary stream). As the nozzle pressure increases, Re' increases, and until $Re'=Re_{cr}'$, the nozzle emits a stream. For values of $Re'\geq Re_{cr}'$, the nozzle provides a fan spray. It was noted that Re' is a modified Reynolds number, which is a function of Re and another parameter that is specific to the circuit. This parameter could be (a) the aspect ratio of the circuit (ratio of depth to width) or (b) ratio of power nozzle width to throat width etc. or (c) combinations of these functions and other specific geometric features like the presence of steps or tapers. The goal then is to reduce $Re_{cr}'$ and to thereby improve CP. It was observed that the lower the value of $Re_{cr}'$, the better the CP, which means the circuit will spray into a desired fan pattern at lower pressures than for prior art nozzles.

$Re_{cr}'$ can be reduced by introducing geometrical features in the fluidic circuit, which is done with knowledge of fluid mechanics and fluidics and with experimentation. This application describes new geometrical features added to the existing feedback circuit to significantly improve its CP. The improved fluidic is therefore identified as the CP feedback circuit.

First, the shape of the feed wall is modified: It has a wide bell-shaped feed that promotes the spreading of the jet as it leaves the power nozzle. This action is important, since the interaction region and feedback channels will be filled sooner (at a lower pressure) and the fluidic will be activated.

Second, the CP feedback circuit includes a downward taper on the floor beginning from the leading edge of the feed. In developmental prototypes, this taper was designed to begin at the leading edge of the insert. The taper was chosen to be in the range of 3 deg-8 deg. Thus, the entire circuit is a diverging channel and promotes expansion of the jet along the side. The jet can then expand in all directions leading to quicker diffusion in the interaction region and formation of vortices, which activate the fluidic.

Third, the ratio (interaction region size/Pw) was increased. Currently this ratio is approx. 11.5. Keep Tw<Pw, (currently, Tw=0.88 Pw), where Tw=throat width, Pw=power nozzle width.

Fourth, short posts were introduced in the feed area. These posts act to enhance the jet expansion from the power nozzle and can also be a filtering element.

The effect of all these features, when combined, is to improve the CP significantly. The pressure needed to produce a spray has been reduced by 10-12 psi (approx. 50%) with a liquid of viscosity 25 cP.

In hand squeeze applications, the CP feedback circuit of the present invention can operate consistently with a light squeeze (~0.5 psi).

The above and still further objects, features and advantages of the present invention will become apparent upon consideration of the following detailed description of a specific embodiment thereof, particularly when taken in conjunction with the accompanying drawings, wherein like reference numerals in the various figures are utilized to designate like components.

DESCRIPTION OF THE PREFERRED EMBODIMENT

Figure 1:
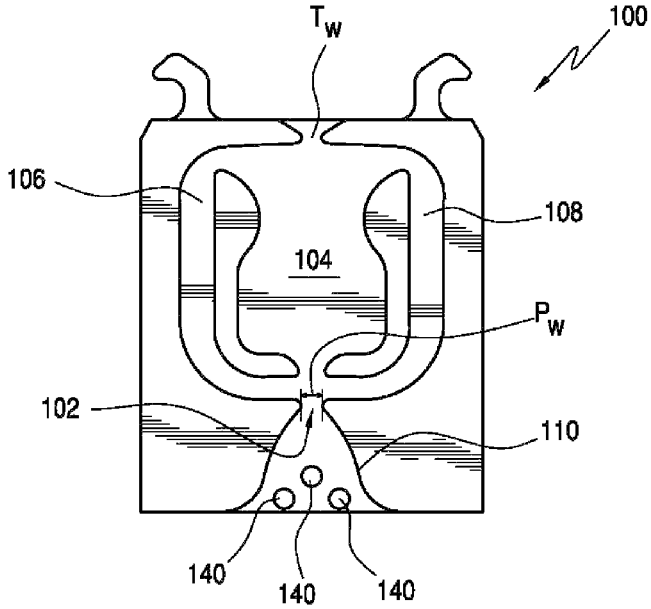
FIG. 1 is a plan view illustrating the interior features of a fluidic circuit for use in a nozzle assembly adapted for making a 3-dimensional spray pattern with cold, viscous fluids, in accordance with the present invention.

Two embodiments of improved Cold Performance nozzle assemblies are illustrated in FIGS. 1-4.

As noted above, cold performance is the ability of a nozzle to spray effectively at cold temperatures (e.g. 0° F.). The liquid used at such temperatures can be an alcohol mix with water that have low freezing points. Thus, the viscosity of the liquid is high (e.g. 25 cP; water viscosity at RT is 1 cP). In essence, CP is the ability of a nozzle to reliably generate oscillation and effectively spray thick or viscous liquids into a desired spray or fan pattern, while pressurized with commercially reasonable fluid pressures.

CP is desirable for certain automotive windshield and headlamp washer nozzles. CP feedback circuits of the present invention are designed for use in the applicant's X-factor 3D spray nozzle for headlamp cleaning. In addition, it can also be used for windshield washer nozzles.

The applications where CP requirements are high include X-factor (3D spray pattern) headlamp cleaning with a mixture of 50-50 ethanol-water at −4 F. squeeze bottle spray etc.

In the headlamp cleaning application, using the prior art fluidics, high nozzle pressure was required for the nozzle to fan with the liquid described above. This high nozzle pressure was not available from a commercially reasonable pumping system, and so the performance of the nozzle assembly was not acceptable. With the CP feedback configuration developed in accordance with the method and structure of the present invention, the pressure requirement for a fan spray was lowered by about 10 psi, making a headlamp cleaning system feasible.

A similar situation exists in a squeeze bottle spray applications, where fluid pressure for the spray must be generated by a user's hand squeeze. Hand squeeze pressures are very low, (e.g., typically 0.5-0.9 psi). For a nozzle to generate the desired spray pattern (or "fan") at such pressures, the applicants have found that the nozzle assembly's CP has to be superior. It was discovered that at such low pressures (e.g. of 0.5-0.9 psi), flow rate is low (where flow, Q=V*A, hence Velocity is also low) and Reynolds number (Re) is low.

As an aside, it is useful to recall that in fluid mechanics, the Reynolds number Re is a dimensionless number that gives a measure of the ratio of inertial forces ($V_\rho$) to viscous forces ($\mu/L$) and, consequently, it quantifies the relative importance of these two types of forces for given flow conditions. Reynolds numbers frequently arise when performing dimensional analysis of fluid dynamics problems, and as such can be used to determine dynamic similitude between different experimental cases. They are also used to characterize different flow regimes, such as laminar or turbulent flow: laminar flow occurs at low Reynolds numbers, where viscous forces are dominant, and is characterized by smooth, constant fluid motion, while turbulent flow occurs at high Reynolds numbers and is dominated by inertial forces, which tend to produce random eddies, vortices and other flow fluctuations.

For the applicant's work, the fluidic circuits were analyzed and it was noted that each circuit has its own characteristic critical number $Re_{cr}'$ when it oscillates effectively and reliably and so gives out a desired fan spray. It was observed that as the nozzle pressure increases, Re' increases, and until $Re'=Re_{cr}'$, the nozzle will give out an ordinary (and undesirable) stream. For values of $Re'\geq Re_{cr}'$, the nozzle will reliably and effectively oscillate and provide a desirable fan spray. Also, it was noted that Re' is a modified Reynolds number, which is a function of Re and another parameter that is specific to the circuit. This parameter could be (a) the aspect ratio of the circuit (ratio of depth to width) or (b) ratio of power nozzle width to throat width etc. or (c) combinations of these functions with other geometric features such as presence of steps or tapers. In accordance with the method of the present invention, the goal is to reduce Re', to improve CP. The applicants' work demonstrated that a lower value of Re', provided better CP, which means the circuit will generate a desired fan pattern at lower pressures.

In accordance with the present invention, Re', can be reduced by introducing geometrical features in the fluidic circuit, which is done with knowledge of fluid mechanics and fluidics, to yield the prototype circuits illustrated in FIGS. 1-4.

This application describes all the new geometrical features developed to enhance an existing feedback circuit to significantly improve its CP, and so the enhanced circuits of the present invention are referred to as CP feedback circuits.

Figure 2:
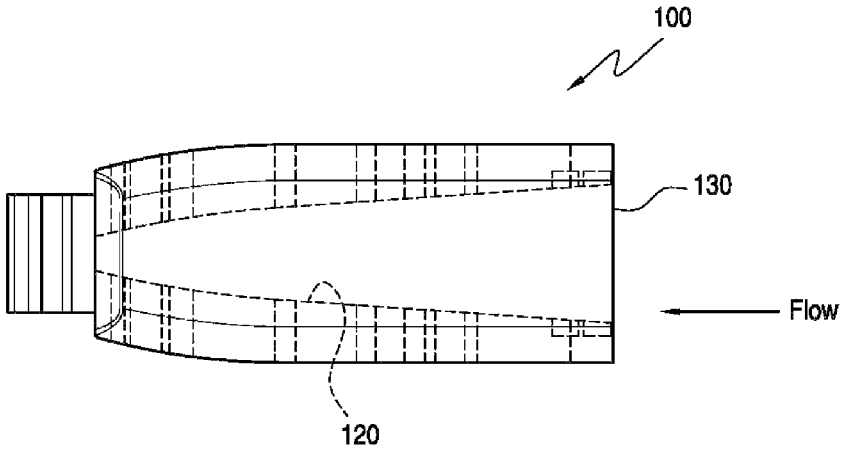
FIG. 2 is a side or transverse view illustrating the interior features of the fluidic circuit in the nozzle assembly of FIG. 1, in accordance with the present invention.

FIG. 1 is a plan view illustrating the interior features of a first CP fluidic circuit 100 for use in a nozzle assembly adapted for making a 3-dimensional spray pattern with cold, viscous fluids, in accordance with the present invention. FIG. 2 is a side or transverse view illustrating the interior features of first CP fluidic circuit 100. Referring to FIGS. 1 and 2, the improved structure of the first CP fluidic circuit 100 includes the following features:

1. Shape of the feed wall. The shape of feed wall 110 is shown in FIG. 1. It has a wide bell-shaped feed that promotes the spreading of the jet as it leaves the power nozzle 102 (having width Pw). This action is important, since the interaction region 104 and feedback channels 106, 108 will be filled sooner (at a lower pressure) and the fluidic will be activated.
2. A downward taper on the floor 120 beginning from the leading edge 130 of the feed, shown in the side view in FIG. 2. This has a similar effect as the feed wall shape. Note that the floor's taper begins all the way from the leading edge 130 of the insert. The applicants chose a taper in the range of 3 deg-8 deg. Thus, the entire circuit is a diverging channel and promotes expansion of the jet along the side. The jet can now expand in all directions leading to quicker diffusion in the interaction region and formation of vortices, which activate the fluidic.
3. Increase the ratio of (interaction region size/Pw). Currently this ratio is approximately 11.5. Also, keep Tw<Pw, (currently, Tw=0.88 Pw), where Tw=throat width, Pw=power nozzle width as shown in FIG. 1.
4. Introduction of short posts 140 in the feed area as shown in FIG. 1. These also act to enhance the jet expansion from the power nozzle 102 and can also be a filtering element.

The effect of these features, when combined, is to improve the CP significantly. As mentioned earlier, applicants have observed CP improvements, where the pressure needed to produce a spray has been reduced by 10-12 psi (approx. 50%), with a liquid of viscosity 25 cP.

In hand squeeze applications, the CP feedback circuit 100 can operate consistently with a light squeeze (~0.5 psi).

The CP feedback circuit 100 may also be incorporated in washer nozzle system incorporating butterfly nozzles as illustrated and described in commonly owned U.S. patent application Ser. No. 11/820,044, the entire disclosure of which is also incorporated herein by reference.

Figure 3:
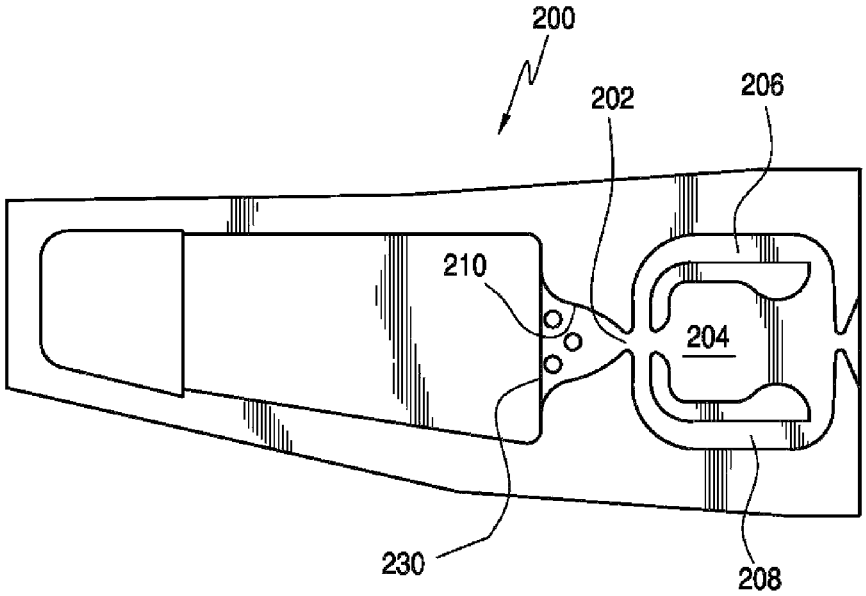
FIG. 3 is a plan view illustrating the interior features of a fluidic circuit for use in a nozzle assembly adapted for making a substantially planar spray pattern with cold, viscous fluids, in accordance with the present invention.

Turning now to a second embodiment. FIG. 3 is a plan view illustrating the interior features of a second CP fluidic circuit 200 for use in a nozzle assembly adapted for making a substantially planar spray pattern with cold, viscous fluids, in accordance with the present invention, and FIG. 4 is a side or transverse view illustrating the interior features of second CP fluidic circuit 200.

Figure 4:
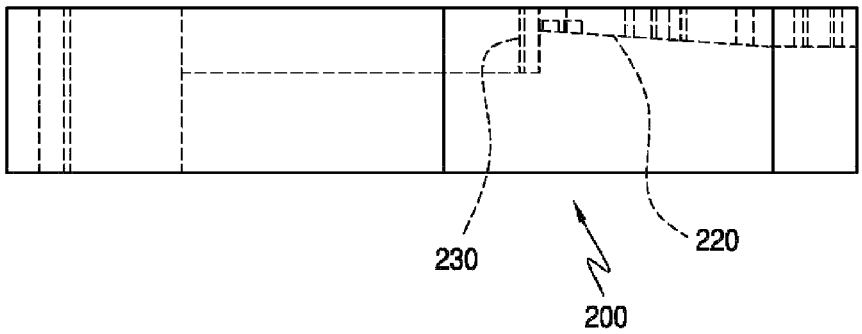
FIG. 4 is a side or transverse view illustrating the interior features of the fluidic circuit in the nozzle assembly of FIG. 3, in accordance with the present invention.

Referring to FIGS. 3 and 4, the improved structure of the illustrative embodiment includes the following features:

1. Shape of the feed wall: The shape of feed wall 210 is shown in FIG. 3. It has a wide bell-shaped feed that promotes the spreading of the jet as it leaves the power nozzle 202. This action is important, since the interaction region 204 and feedback channels 206, 208 will be filled sooner (at a lower pressure) and the fluidic will be activated.
2. A downward taper on the floor 220 beginning from the leading edge 230 of the feed, shown in the side view in FIG. 4. This has a similar effect as the feed wall. Note that the taper begins all the way from the leading edge 230 of the insert. Applicants chose a taper in the range of 3 deg-8 deg. Thus, the entire circuit is a diverging channel and promotes expansion of the jet along the side. The jet can now expand in all directions leading to quicker diffusion in the interaction region and formation of vortices, which activate the fluidic.

3. Increase the ratio of interaction region size to Pw. Currently this ratio is approx. 11.5. Keep Tw<Pw, (currently, Tw=0.88 Pw). Tw=throat width, Pw=power nozzle 202 width.
4. Introduction of short posts in the feed area as shown in FIG. 3. These also act to enhance the jet expansion from the power nozzle and can also be a filtering element.

These features also improve the CP significantly. As above, applicants have observed CP improvements where the pressure needed to produce a spray has been reduced by 10-12 psi (approx. 50%), with a liquid of viscosity 25 cP. In hand squeeze applications, the CP feedback circuit 200 can operate consistently with a light squeeze (~0.5 psi). The CP feedback circuit 200 may also be incorporated in washer nozzle system incorporating "butterfly nozzles" as illustrated and described in commonly owned U.S. patent application Ser. No. 11/820,044, the entire disclosure of which is also incorporated here by reference.

It will be appreciated by those of skill in the art that the present invention makes a significant improvement in cold spray performance available, and the features of the illustrative embodiments can be combined in various ways.

A washer nozzle system adapted for use with cold or viscous fluids will include a source of washer fluid under pressure (not shown), a fluidic oscillator (e.g., 100 or 200) having a power nozzle, an oscillation chamber having an upstream end coupled to the power nozzle for issuing a jet of washer liquid into the oscillation chamber and a downstream end having an outlet aperture for issuing a jet of washer fluid into ambient space. The side and top and bottom walls define an oscillation inducing interaction region in the oscillation chamber for causing the jet of washer fluid to rhythmically sweep back and forth between the sidewalls in the oscillation chamber, and the oscillation inducing interaction region defines a throat width $T_W$ and a power nozzle width $P_W$. The upstream end includes a bell-shaped feed (e.g., with wall 110) that promotes the spreading of the jet as it leaves the power nozzle, and the interaction region and feedback channels are quickly filled at a low pressure and the fluidic is activated.

Preferably, the oscillation chamber's bottom wall includes a downward taper on the floor beginning from a leading edge of the feed, and the taper begins from the leading edge (e.g. 130) and is in the range of 3-8 deg from horizontal, so that the fluidic oscillator defines a diverging channel and promotes expansion of the jet along the side. In this way, the fluid jet can expand in all directions and provide quicker diffusion in the interaction region with resulting formation of vortices, which activate the fluidic. It is also preferred that the interaction region is configured so that throat width is less than power nozzle width, and ideally, throat width is equal to approximately 0.88 times the power nozzle width. It is also preferable to include a plurality (e.g., first, second and third) short, inwardly projecting cylindrical posts 140 in the feed area to enhance the jet expansion from the power nozzle and to provide a filtering element.

A fluid spraying system or nozzle made in accordance with the present invention is adapted for automotive use (e.g., as a vehicle washer nozzle) with enhanced cold performance, where the fluid used preferably comprises a washing solution such as a mixture of an antifreeze agent (e.g., ethanol) and water (e.g., equal parts ethanol and water).

The nozzle of the present invention is also readily configured to provide consistent operation with light squeeze pressures when used with a hand squeeze bottle, while also providing with enhanced cold performance.

Having described preferred embodiments of a new and improved structure and method, it is believed that other modifications, variations and changes will be suggested to those skilled in the art in view of the teachings set forth herein. It is therefore to be understood that all such variations, modifications and changes are believed to fall within the scope of the present invention as set forth in the claims.

What is claimed is:

1. A nozzle system adapted for use with cold fluids, viscous fluids or fluids under light pressure comprising:

a source of fluid under pressure, a fluidic oscillator having an inlet in fluid communication with said source and including a power nozzle, said oscillator further including an oscillation chamber having an upstream end with an inlet coupled to said power nozzle for issuing a jet of fluid into said oscillation chamber and a downstream end having an outlet aperture for issuing a jet of fluid into ambient space;

said oscillator further including and opposing first and second side walls which intersect opposing top and bottom walls to define an oscillation inducing interaction region in said oscillation chamber for causing said jet of fluid to rhythmically sweep back and forth between said sidewalls in said oscillation chamber;

wherein said oscillation inducing interaction region defines a throat width and a power nozzle width;

wherein said upstream end comprises a bell-shaped feed that promotes the spreading of the jet as it leaves the power nozzle;

wherein the interaction region and feedback channels are quickly filled with fluid from said source at a low pressure and the fluidic oscillator is activated;

wherein said oscillation chamber's bottom wall terminates at a leading edge and includes a taper beginning from said leading edge, proximate said inlet;

wherein the ratio of interaction region is configured such that said throat width is less than said power nozzle width;

wherein a plurality of short posts project inwardly in the feed area to enhance the jet expansion from the power nozzle and to provide a filtering element; and wherein said plurality of short posts comprises a first short post, a second short post and a third short post.

2. A fluid spraying system adapted to generate an oscillating spray fan pattern for use with cold fluids, viscous fluids or fluids under light pressure comprising:

a source of fluid under light pressure, a fluidic oscillator having an inlet in fluid communication with said source and including a power nozzle, said oscillator further including an oscillation chamber having an upstream end with an inlet coupled to said power nozzle for issuing a jet of fluid into said oscillation chamber and a downstream end having an outlet aperture for issuing a jet of fluid into ambient space;

said oscillator further including opposing first and second side walls which intersect opposing top and bottom walls to define an oscillation inducing interaction region in said oscillation chamber for causing said jet of fluid to rhythmically sweep back and forth between said sidewalls in said oscillation chamber;

wherein said oscillation inducing interaction region defines a throat width and a power nozzle width;

wherein said upstream end comprises a bell-shaped feed that promotes the spreading of the jet as it leaves the power nozzle;

wherein the interaction region and feedback channels are quickly filled with fluid from said source at a low pressure and the fluidic oscillator is activated;

wherein said oscillation chamber's bottom wall terminates at a leading edge and includes a taper beginning from said leading edge, proximate said inlet;

wherein the ratio of interaction region is configured such that said throat width is less than said power nozzle width; and wherein a plurality of short posts project inwardly in the feed area to enhance the jet expansion from the power nozzle and to provide a filtering element.

3. The fluid spraying system of claim 2, wherein the oscillator is adapted to provide consistent operation with light squeeze pressures when used with a hand squeeze bottle, while also providing with enhanced cold performance.

4. The fluid spraying system of claim 2 wherein, the oscillator is adapted to provide consistent operation with light pressures in the range of 0.5 to 0.9 psi.

5. The fluid spraying system of claim 4 wherein the oscillator is adapted to provide consistent operation with light squeeze pressures of 0.5 psi when used with a hand squeeze bottle, while also providing with enhanced cold performance.

6. The fluid spraying system of claim 2 wherein the oscillator is adapted to provide consistent operation when said fluid comprises a washing solution formulated for use on automotive windshields.

7. The fluid spraying system of claim 6 wherein the oscillator is adapted to provide consistent operation when said washing solution comprises a mixture of an antifreeze agent and water.

8. The fluid spraying system of claim 7 wherein the oscillator is adapted to provide consistent operation when said washing solution comprises a mixture of substantially equal parts of ethanol and water.

9. A nozzle system adapted for use with cold fluids, viscous fluids or fluids under light pressure comprising:

a source of fluid under pressure, a fluidic oscillator having an inlet in fluid communication with said source and including a power nozzle, said oscillator further including an oscillation chamber having an upstream end with an inlet coupled to said power nozzle for issuing a jet of fluid into said oscillation chamber and a downstream end having an outlet aperture for issuing a jet of fluid into ambient space;

said oscillator further including and opposing first and second side walls which intersect opposing top and bottom walls to define an oscillation inducing interaction region in said oscillation chamber for causing said jet of fluid to rhythmically sweep back and forth between said sidewalls in said oscillation chamber;

wherein said oscillation inducing interaction region defines a throat width and a power nozzle width;

wherein said upstream end comprises a bell-shaped feed that promotes the spreading of the jet as it leaves the power nozzle;

wherein the interaction region and feedback channels are quickly filled with fluid from said source at a low pressure and the fluidic oscillator is activated;

wherein said oscillation chamber's bottom wall terminates at a leading edge and includes a taper beginning from said leading edge, proximate said inlet wherein the ratio of interaction region is configured such that said throat width is less than said power nozzle width, and wherein a plurality of short posts project inwardly in the feed area to enhance the jet expansion from the power nozzle and to provide a filtering element.

10. The nozzle system of claim 9, wherein the nozzle is adapted for use as a vehicle washer nozzle with enhanced cold performance.

11. The fluid spraying system of claim 10 wherein the oscillator is adapted to provide consistent operation when said washing solution comprises a mixture of an antifreeze agent and water.

12. The nozzle system of claim 9, wherein said taper is in the range of 3-8 degrees, and whereby the fluidic oscillator defines a diverging channel and promotes expansion of the jet along the side; and whereby the jet can expand in all directions leading to quicker diffusion in the interaction region and formation of vortices, which activate the fluidic.

13. The nozzle system of claim 9, wherein the throat width, is approximately 0.88× said power nozzle width.

14. The nozzle system of claim 9, wherein the nozzle is adapted to provide consistent operation with light squeeze pressures when used with a hand squeeze bottle, while also providing with enhanced cold performance.

15. The nozzle system of claim 9, wherein, the nozzle is adapted to provide consistent operation with light squeeze pressures in the range of 0.5 to 0.9 psi.

16. The nozzle system of claim 15, wherein the nozzle is adapted to provide consistent operation with light squeeze pressures of 0.5 psi when used with a hand squeeze bottle, while also providing with enhanced cold performance.

* * * * *